US009668302B2

(12) United States Patent
Kamitani

(10) Patent No.: US 9,668,302 B2
(45) Date of Patent: May 30, 2017

(54) CERAMIC HEATER

(75) Inventor: Satoru Kamitani, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 415 days.

(21) Appl. No.: 14/008,793

(22) PCT Filed: Mar. 30, 2012

(86) PCT No.: PCT/JP2012/058632

§ 371 (c)(1),
(2), (4) Date: Sep. 30, 2013

(87) PCT Pub. No.: WO2012/133800

PCT Pub. Date: Oct. 4, 2012

(65) Prior Publication Data

US 2014/0042149 A1 Feb. 13, 2014

(30) Foreign Application Priority Data

Mar. 31, 2011 (JP) ..... 2011-079663

(51) Int. Cl.
*H05B 3/16* (2006.01)
*H05B 3/48* (2006.01)

(52) U.S. Cl.
CPC ..... *H05B 3/16* (2013.01); *H05B 3/48* (2013.01)

(58) Field of Classification Search
CPC . H05B 3/14; H05B 3/141; H05B 3/16; H05B 3/48
See application file for complete search history.

(56) References Cited

U.S. PATENT DOCUMENTS 5,294,477 A * 3/1994 Kanba ..... H01L 23/142 257/E23.006
5,587,097 A * 12/1996 Sato ..... H05B 3/16 219/121.68

(Continued)

FOREIGN PATENT DOCUMENTS

CN 2810085 Y 8/2006
JP 6127084 A 2/1986

(Continued)

OTHER PUBLICATIONS

Chinese Office Action with English concise explanation, Chinese Patent Application No. 201280015086.4, Dec. 31, 2014, 7 pgs.

(Continued)

*Primary Examiner* — David Angwin
*Assistant Examiner* — Erin McGrath
(74) *Attorney, Agent, or Firm* — Volpe and Koenig, P.C.

(57) ABSTRACT

A ceramic base body, which is a ceramic heater which suppresses noise radiation and thus has little adverse effect on surrounding electronic devices, includes a plurality of ceramic layers, and a mixed-material layer disposed between two ceramic layers, the mixed-material layer being formed of a mixture of a ceramic material and a metal material. Between the ceramic layer and the mixed-material layer, a heat-generating resistor which generates heat by a passage of electric current therethrough is disposed. Radiation of a high-frequency component generated by the passage of electric current through the heat-generating resistor is suppressed by the mixed-material layer, wherefore the adverse effect of the radiation on surrounding electronic devices can be reduced.

6 Claims, 3 Drawing Sheets

(56) References Cited

U.S. PATENT DOCUMENTS

| | | | | |
|---|---|---|---|---|
| 6,054,690 | A * | 4/2000 | Petit | D06F 75/24 219/528 |
| 6,274,855 | B1 * | 8/2001 | Tatematsu | H05B 3/141 219/505 |
| 6,322,897 | B1 * | 11/2001 | Borchert | B22F 3/1109 428/469 |
| 7,800,021 | B2 * | 9/2010 | Pilavdzic | C23C 28/321 219/212 |
| 2004/0244695 | A1 | 12/2004 | Hashikura et al. | |
| 2005/0145617 | A1 * | 7/2005 | McMillin | H05B 3/28 219/543 |

FOREIGN PATENT DOCUMENTS

| | | | |
|---|---|---|---|
| JP | 05315055 | A | 11/1993 |
| JP | 10-335050 | A | 12/1998 |
| JP | 2003086334 | A | 3/2003 |
| JP | 2004363334 | A | 12/2004 |

OTHER PUBLICATIONS

International Preliminary Report on Patentability, International Patent Application No. PCT/JP2012/058632, Oct. 1, 2013, 5 pp. with an English Translation, Oct. 8, 2013, 5 pp.

International Search Report, PCT/JP2012/058632, Apr. 11, 2012, 2 pp.

Korean Office Action with English concise explanation, Korean Patent Appln. No. 10-2013-7024264, Aug. 29, 2014.

* cited by examiner

CERAMIC HEATER

CROSS-REFERENCE TO RELATED APPLICATIONS

This application is a 371 of International Application No. PCT/JP2012/058632 filed on Mar. 30, 2012, which claims the benefit of JP 2011-079663, which was filed on Mar. 31, 2011, and are incorporated herein by reference.

FIELD OF INVENTION

The present invention relates to a ceramic heater for use in hair irons, heaters for water heating, oxygen sensors, air-fuel ratio sensors, glow plugs, a semiconductor manufacturing apparatus, and so forth.

BACKGROUND

In the interest of durability enhancement, ceramic heaters for heating an object to be heated generally employ a structure in which a heat-generating resistor formed of a high-melting-point metal such as tungsten is disposed in a pattern within a ceramic sintered body composed predominantly of alumina (refer to Patent Literature 1, for example).

The heat-generating resistor, which is formed in a linear shape or a plate-like shape, generates Joule heat by the passage of electric current therethrough. The heat generated in the heat-generating resistor is transmitted through the ceramic sintered body for raising the surface temperature of the ceramic sintered body.

A ceramic heater is required to have the capability of adjusting the surface temperature of a ceramic sintered body to a predetermined temperature. For example, the surface temperature of a ceramic sintered body can be controlled by varying the value of electric current which is passed through the heat-generating resistor. As the electric current value is increased, the amount of heat generated is increased correspondingly with a consequent rise in surface temperature, and, on the other hand, as the electric current value is decreased, the amount of heat generated is decreased correspondingly with a consequent drop in surface temperature.

CITATION LIST

Patent Literature

Patent Literature 1: Japanese Unexamined Patent Publication JP-A 5-315055 (1993)

SUMMARY

Technical Problem

Ceramic heaters are utilized in various application areas, and chances are high that electronic devices will be placed in the vicinity of a ceramic heater. When electric current is passed through a heat-generating resistor of the ceramic heater to cause the ceramic heater to generate heat, then a high-frequency component generated in the heat-generating resistor is radiated from the ceramic heater, and it may adversely affect surrounding electronic devices as noise.

An object of the invention is to provide a ceramic heater which is capable of suppressing noise radiation and thus has little adverse effect on surrounding electronic devices.

Solution to Problem

The invention provides a ceramic heater comprising: a ceramic base body; a heat-generating resistor disposed in an interior of the ceramic base body, the heat-generating resistor generating heat by a passage of electric current therethrough; and a mixed-material layer disposed in the interior of the ceramic base body, the mixed-material layer being formed of a mixture of a ceramic material and a metal material.

Advantageous Effects of Invention

According to the ceramic heater of the invention, in the interior of the ceramic base body, there are provided the heat-generating resistor which generates heat by the passage of electric current therethrough, and the mixed-material layer formed of a mixture of a ceramic material and a metal material.

In this construction, radiation of a high-frequency component generated by the passage of electric current through the heat-generating resistor is suppressed by the mixed-material layer, wherefore the adverse effect of the radiation on surrounding electronic devices can be reduced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Hereinafter, a ceramic heater embodying the invention will be described in detail with reference to drawings.

Figure 1:
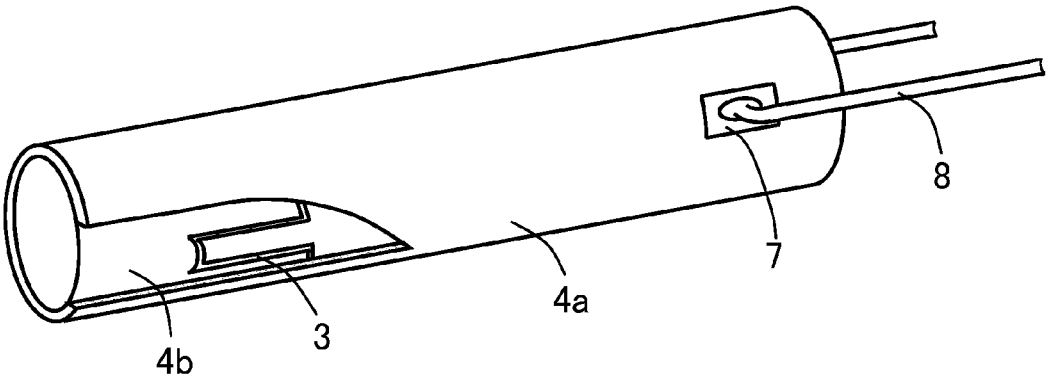
FIG. 1 is a perspective view, partly broken away, of a ceramic heater 1 in accordance with a first embodiment of the invention, schematically illustrating the structure thereof.
Figure 2:
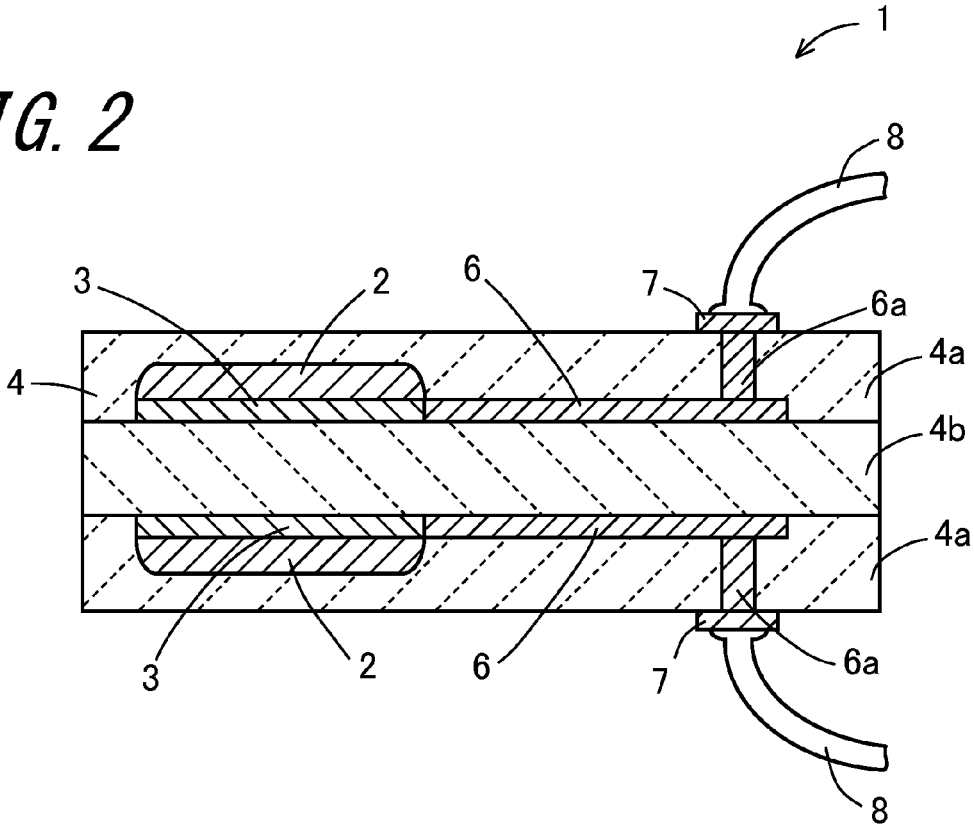
FIG. 2 is a sectional view showing the structure of the ceramic heater 1.

FIG. 1 is a perspective view, partly broken away, of a ceramic heater 1 in accordance with a first embodiment of the invention, schematically illustrating the structure thereof. FIG. 2 is a sectional view showing the structure of the ceramic heater 1.

The ceramic heater 1 of the present embodiment comprises a ceramic base body 4, and a mixed-material layer 2 and a heat-generating resistor 3 embedded in the interior of the ceramic base body 4.

The ceramic base body 4 is formed of a plurality of ceramic layers 4*a*, 4*b* combined into rod form (cylindrical column form). More specifically, as shown in FIG. 2, the centrally-located ceramic layer 4*b* has a rod shape (a cylindrical column shape), and the ceramic layer 4*a* is placed around the outer periphery of the ceramic layer 4*b*. Disposed between the ceramic layer 4*a* and the ceramic layer 4*b* is the mixed-material layer 2 formed of a mixture of a ceramic material and a metal material. Disposed between the ceramic layer 4*b* and the mixed-material layer 2 is the heat-generating resistor 3 which generates heat by the passage of electric current therethrough.

The heat-generating resistor 3 has its end electrically connected to a lead portion 6, and the lead portion 6 is connected to a pad portion 7 disposed on the outer surface of the ceramic base body 4. A power-supply wiring line 8 is connected, through a brazing material, to the pad portion 7. The power-supply wiring line 8 is connected to a power-supply device (not shown) for passing electric current through the heat-generating resistor 3.

The heat-generating resistor 3, which is formed for example of a metal material that can be co-fired with the ceramic layer 4*a*, 4*b*, has a main surface opposed to the heating surface of the ceramic base body 4, and a side surface contiguous to the main surface. One of, or two or more of tungsten, molybdenum, and rhenium can be used as the metal material capable of co-firing. Moreover, the heat-generating resistor 3 is disposed, in the form of a flat plate or line having a rectangular sectional profile for example, in a predetermined region between the ceramic layer 4*a* and the ceramic layer 4*b*, viz., a region to be heated. Where the heat-generating resistor 3 in line form is disposed, it is given a meander shape, a spiral shape, a wave shape, and so forth. The heat-generating resistor 3 has a line width in a rage of 0.1 to 5 mm and a thickness in a range of 0.01 to 1 mm, for example.

The ceramic base body 4 is formed of a ceramic material such as alumina, silicon nitride, aluminum nitride, or silicon carbide. Heat generated in the heat-generating resistor 3 is transmitted through the interior of the ceramic base body 4, so that the outer surface of the ceramic base body 4 can be heated.

The mixed-material layer 2 is formed by mixing a ceramic material and a metal material. The ceramic material used to form the mixed-material layer 2 may be of the same type as the ceramic material used for the ceramic base body 4, and may either be identical with or differ from the ceramic material constituting the ceramic base body 4. The metal material used to form the mixed-material layer 2 may be of the same type as the metal material used for the heat-generating resistor 3, and may either be identical with or differ from the metal material used for the heat-generating resistor 3. Rhenium is desirable for use as the metal material constituting the mixed-material layer 2. Rhenium exhibits excellent resistance to oxidation, and thus the use of rhenium makes it possible to increase the permissible duration of electric current-carrying time. Note that the mixed-material layer 2 is disposed over the entire lengthwise region of the heat-generating resistor 3. Moreover, the mixed-material layer 2 has a thickness in a range of 0.01 to 0.5 mm, for example.

Like the heat-generating resistor 3, the lead portion 6 is disposed between the ceramic layer 4*a* and the ceramic layer 4*b*. The lead portion 6 is an innerlayer wiring line formed of a metal material of the same type as that constituting the heat-generating resistor 3. In order to establish connection with the pad portion 7, for example, a via conductor 6*a* is provided that passes through the ceramic base body 4 in the direction of its thickness so as to extend to the outer surface of the ceramic base body 4.

In a case where the ceramic heater 1 has a cylindrical column shape, for example, the outer diameter thereof falls in a range of 1 to 30 mm, and the axial length thereof falls in a range of 5 to 200 mm. Moreover, although not shown in the figures, where the ceramic heater 1 has a plate-like shape, for example, has its whole size of 5 to 200 mm square, and has a thickness in a range of 1 to 30 mm.

With the aim of causing a rapid temperature rise in the ceramic heater 1, when large electric current is passed through the heat-generating resistor 3 of the ceramic heater 1 at the start of heating-up operation, then, like a rectangular-wave pulse pattern, a sharp rise in waveform appears in accompaniment with inrush current, and high-power current containing a high-frequency component enters the heat-generating resistor 3.

Noise attributed to such a high-frequency component is defined as radio noise which becomes a problem in a certain frequency band (150 kHz to 1 GHz) that usually brings about electromagnetic interference. This noise is broadly classified into conductive noise which propagates through power-supply wiring and so forth and radiative noise which is radiated out into space.

As typical troubles, a malfunction or encounter of noise occurs in an apparatus due to unnecessary radiation noise that is caused, besides communication signals, in a radio, wireless communication, network communication, and so forth. In phase control, a sharp rise in voltage- and current-waveform appears at turn-on, wherefore click noise in a radio-frequency range (mainly from several tens of KHz up to several tens of MHz) occurs, which leads to adverse effect on control systems, as well as to radio disturbance in peripherals.

According to the invention, the high-frequency component generated in the heat-generating resistor 3 at the start of heating-up operation is attenuated by the mixed-material layer 2. By virtue of the attenuation, it is possible to suppress radiation of high-frequency components from the ceramic heater 1 to the outside, and thereby reduce adverse effect exerted on electronic devices placed in the vicinity of the ceramic heater.

The mixed-material layer 2 of this embodiment is disposed at the side of one main surface of the heat-generating resistor 3 opposed to the heating surface of the ceramic base body 4, so that a high-frequency component emanating from the main surface can be attenuated by the mixed-material layer 2. In this embodiment, the ceramic base body 4 has the form of a rod, and, a pattern of the heat-generating resistor 3 is formed on an outer peripheral surface of the rod-like ceramic layer 4*b* (ceramic core), and the ceramic layer 4*a* is formed on the outside of the heat-generating resistor pattern. In such a construction of this embodiment, the heating surface of the ceramic base body 4 refers to the outer surface of the ceramic base body 4, and one main surface of the heat-generating resistor 3 opposed to the heating surface of the ceramic base body 4 refers to the radially outward main surface of the heat-generating resistor 3.

Moreover, where the ceramic base body 4 has a plate-like shape, the heating surface of the ceramic base body 4 refers to the outer surface of that side of the ceramic base body 4 which acts to heat an object to be heated. In general, the heat-generating resistor 3 is placed near the heating surface of the ceramic base body 4, wherefore one main surface of the heat-generating resistor 3 opposed to the heating surface of the ceramic base body 4 means the main surface of the heat-generating resistor 3 located closer to the outer surface of the ceramic base body 4.

Moreover, where the ceramic material constituting the mixed-material layer 2 is substantially equal in thermal conductivity to the ceramic material constituting the ceramic base body, the mixed-material layer 2 exhibits a thermal conductivity higher than that of the ceramic base body 4 because of having a metal-material content.

In the case where the ceramic heater 1 has a plate-like shape, it is required that temperature distribution be rendered uniform throughout the main surface. In general, the main surface exhibits higher surface temperature due to the placement of the heat-generating resistor, whereas other area exhibits lower surface temperature, which is likely to cause lack of uniformity in temperature distribution. In this regard, in the ceramic heater 1, the provision of the mixed-material layer 2 having high thermal conductivity allows the widening of the region subjected to transmission of heat from the heat-generating resistor 3 acting as a heat source, which results in improvement in the uniformity of surface temperature distribution.

Figure 3:
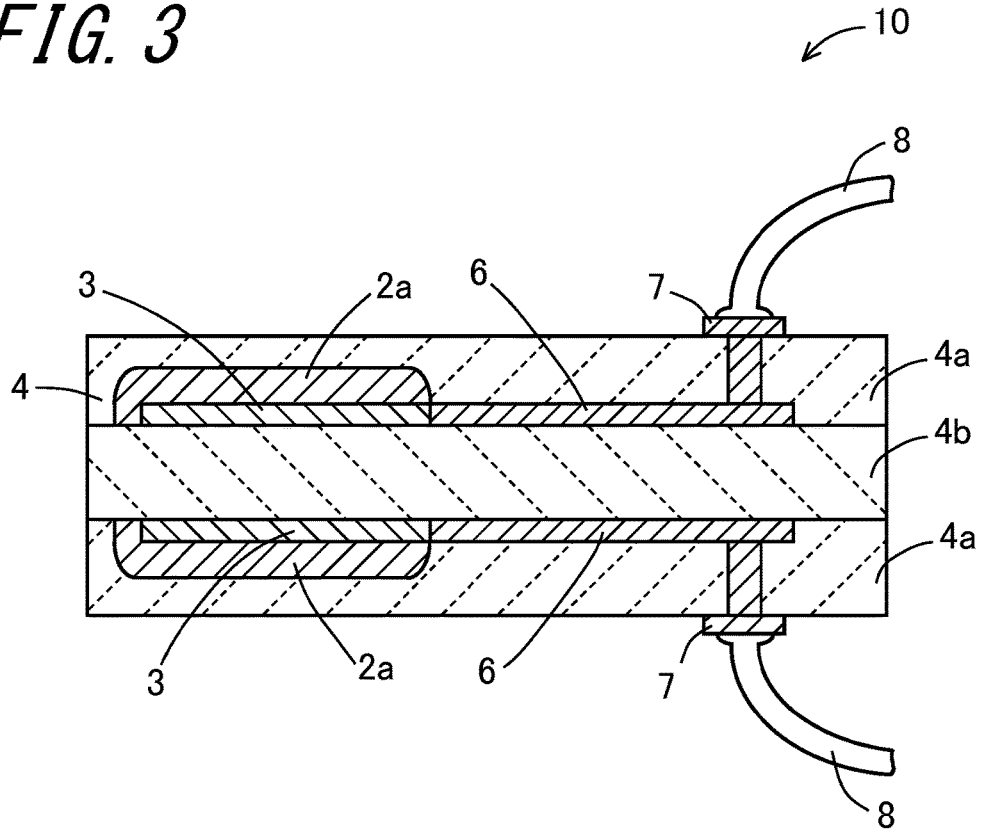
FIG. 3 is a sectional view showing the structure of a ceramic heater 10 in accordance with a second embodiment of the invention.

FIG. 3 is a sectional view showing the structure of a ceramic heater 10 in accordance with a second embodiment of the invention.

In the ceramic heater 10 of this embodiment, its mixed-material layer 2*a* differs structurally from the mixed-material layer 2 of the first embodiment, which is the only point of difference, and other constituent components will therefore be identified with the same reference symbols as used in the first embodiment, and overlapping descriptions will be omitted.

In this embodiment, the mixed-material layer 2*a* is so formed as to cover, in addition to one main surface of the heat-generating resistor 3, a side surface thereof. A high-frequency component which causes noise is generated not only from one main surface of the heat-generating resistor 3, but also from the side surface thereof. In this embodiment, since the mixed-material layer 2*a* covers the side surface of the heat-generating resistor 3 additionally, it is possible to achieve further attenuation of high-frequency components radiated from the heat-generating resistor 3, and thereby achieve further reduction in adverse effect exerted on electronic devices placed in the vicinity of the ceramic heater.

Moreover, since the region for providing the mixed-material layer 2*a* is wider than that for the mixed-material layer 2 of the first embodiment, it is possible to achieve further widening of the region subjected to transmission of heat from the heat-generating resistor 3 acting as a heat source, and thereby achieve further improvement in the uniformity of surface temperature distribution.

Figure 4:
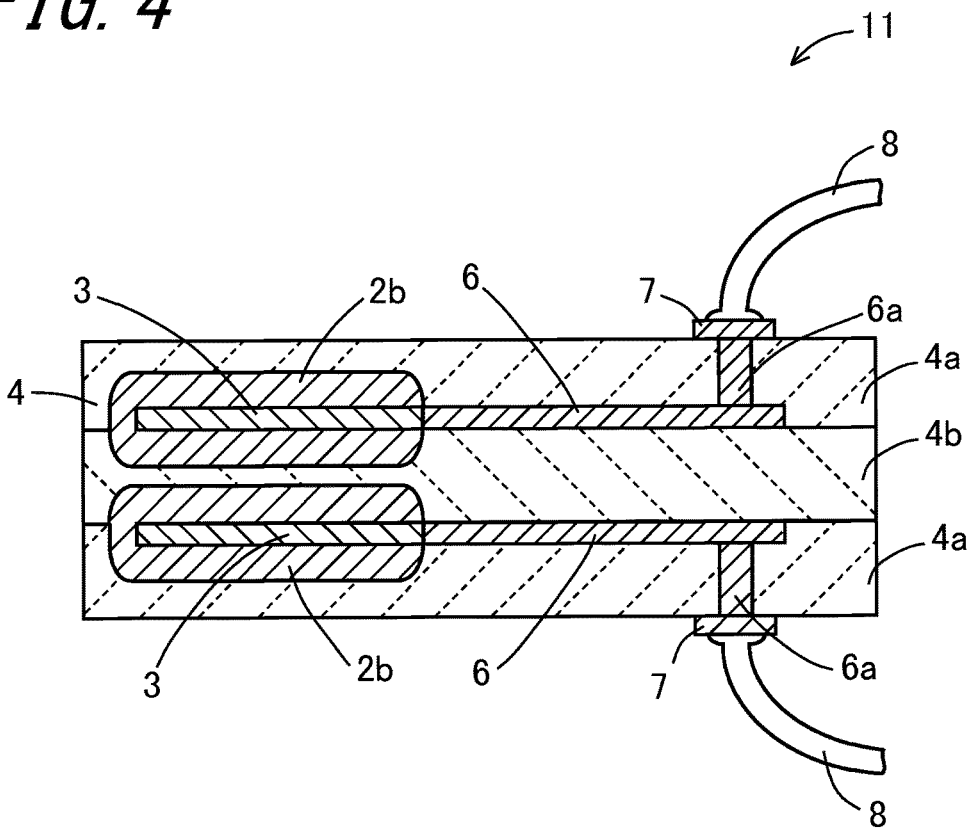
FIG. 4 is a sectional view showing the structure of a ceramic heater 11 in accordance with a third embodiment of the invention.

FIG. 4 is a sectional view showing the structure of a ceramic heater 11 in accordance with a third embodiment of the invention.

In the ceramic heater 11 of this embodiment, its mixed-material layer 2*b* differs structurally from the mixed-material layer 2 of the first embodiment, which is the only point of difference, and other constituent components will therefore be identified with the same reference symbols as used in the first embodiment, and overlapping descriptions will be omitted.

In this embodiment, the mixed-material layer 2*b* is formed on one main surface of the heat-generating resistor 3 so as to extend over a side surface and the other main surface for entirely covering the heat-generating resistor 3. A high-frequency component which causes noise is generated from the heat-generating resistor 3 as a whole. In this embodiment, since the mixed-material layer 2*b* covers the entire heat-generating resistor 3, it is possible to attenuate high-frequency components radiated from the heat-generating resistor 3 even further, and thereby reduce adverse effect exerted on electronic devices placed in the vicinity of the ceramic heater even further.

Moreover, since the region for providing the mixed-material layer 2*b* is wider than that for providing the mixed-material layer 2 of the first embodiment, as well as the mixed-material layer 2*a* of the second embodiment, it is possible to widen the region subjected to transmission of heat from the heat-generating resistor 3 acting as a heat source even further, and thereby improve the uniformity of surface temperature distribution even further.

When electric current at DC voltage is passed through the heat-generating resistor of the ceramic heater continuously or cyclically, ion migration takes place, and more specifically metal components or oxygen ions contained in the metal material of the heat-generating resistor and the ceramic base body migrate, which may lead to breaking in the heat-generating resistor. Accordingly, in the ceramic heater, the time for the passage of electric current is limited to an extent that prevents occurrence of ion migration.

By placing the mixed-material layer 2*b* so as to cover the entire heat-generating resistor 3 as practiced in this embodiment, it is possible to relieve concentration of lines of electric force during electric current passage, and thereby suppress ion migration and prevent occurrence of breaking. Note that, in this embodiment, the ceramic base body 4 is formed by combining, as two halves, ceramic layers having a semicircular sectional profile as seen in a direction perpendicular to the axial direction into a cylindrical column form, and thus this embodiment is especially advantageous when it is desired to place the heat-generating resistor 3 between ceramic layers provided as two halves of a ceramic body.

Another embodiment of the invention is structurally pursuant to the first to third embodiments thus far described, and in addition features metal-material distribution in its mixed-material layer. Although the mixed-material layer 2 of the first embodiment will be described hereinbelow, the following description holds true for the mixed-material layer 2*a* of the second embodiment and the mixed-material layer 2*b* of the third embodiment as well.

In this embodiment, the mixed-material layer 2 is so configured that the mixing rate of a metal material blended therein becomes lower gradually with decreasing proximity to the heat-generating resistor 3. That is, that region of the mixed-material layer located close to the heat-generating resistor 3 has a higher metal-material rate, whereas that region thereof located away from the heat-generating resistor 3 has a lower metal-material rate. For example, the blend amount of the metal material in the region with the lowest metal-material rate is ⅕ to 1/20 of the blend amount of the metal material in the region with the highest metal-material rate.

There is a difference in thermal expansion coefficient between the heat-generating resistor 3 and the ceramic layer 4*a*, 4*b*. When electric current is passed through the ceramic heater 1 cyclically, a microcrack appears between the heat-generating resistor 3 and the ceramic layer 4*a*, 4*b* under the influence of the difference in thermal expansion coefficient. This microcrack develops further as the number of cycles is increased, which eventually causes breaking in the heat-generating resistor 3.

The thermal expansion coefficient of the mixed-material layer 2 is smaller than that of the heat-generating resistor 3, yet is larger than that of the ceramic layer 4*a*, 4*b*, wherefore, even if the metal material is distributed evenly in the mixed-material layer 2, it is possible to suppress occurrence of a microcrack to some extent. As practiced in this embodiment, where the mixed-material layer 2 is so configured that the mixing rate of the metal material becomes lower gradually with increasing the distance from the heat-generating resistor 3, the thermal expansion coefficient of the mixed-material layer 2 varies from the heat-generating resistor 3-sided part to the ceramic layer 4*a*, 4*b*-sided part correspondingly, and it is possible to further suppress occurrence of a microcrack.

Still another embodiment of the invention is structurally pursuant to the earlier described second and third embodiments, and in addition features the thickness of its mixed-material layer. Although the mixed-material layer 2*a* of the second embodiment will be described hereinbelow, the following description holds true for the mixed-material layer 2*b* of the third embodiment.

In this embodiment, the mixed-material layer 2*a* is so configured that the thickness of a part thereof located on one main surface side of the heat-generating resistor 3 opposed to the heating surface of the ceramic base body 4 is larger than the thickness of a residual part of the mixed-material layer. The thickness of the residual part is ⅓ to 1/10 of the thickness of the part contiguous to the main surface.

Most of heat generated in the heat-generating resistor 3 travels from the main surface thereof outward in the direction of thickness of the ceramic layer 4*a*. Accordingly, by imparting a larger thickness to the part of the mixed-material layer contiguous to the main surface, it is possible to facilitate transmission of heat from the main surface outward in the thickness-wise direction, and thereby speed up a rise in the surface temperature of the ceramic heater 1.

It is noted that the mixed-material layer 2 (2*a*, 2*b*) is a region containing a metal component which is not contained in the ceramic base body 4, and, a boundary between the ceramic base body 4 and the mixed-material layer 2 (2*a*, 2*b*) can be identified by making observation of the section by means of wavelength-dispersive x-ray spectrometry (WDS analysis), for example. More specifically, the boundary between the ceramic base body 4 and the mixed-material layer 2 can be identified, based on the presence or absence of a metal component, by cutting a sample of the ceramic heater 1 as shown in FIG. 1 in the direction of its length, polishing the section to a mirror-smooth state, and conducting color mapping on the target metal component in the vicinity of the boundary between the ceramic base body 4 and the mixed-material layer 2 (2*a*, 2*b*) by means of WDS analysis using an electron probe microanalyzer (JXA-8100 manufactured by JEOL Ltd).

Next, a method for manufacturing the ceramic heater 1 will be described.

A ceramic material having insulation property, such as oxide ceramics, nitride ceramics, or carbide ceramics can be used for the ceramic base body 4. More specifically, alumina, silicon nitride, aluminum nitride, silicon carbide, and so forth can be used. Among them, the use of alumina is desirable from the standpoint of resistance to oxidation.

Firstly, to produce the ceramic heater 1 formed of such a ceramic material, a ceramic slurry prepared by adding a sintering aid such as SiO2, CaO, MgO, or ZrO2 to the aforementioned ceramic component is shaped like a sheet to prepare a ceramic green sheet. Alternatively, a mixture of the aforementioned components is subjected to press molding, extrusion molding, or the like process to prepare a rod-like or plate-like molded product.

The ceramic green sheet or molded product is formed into the ceramic layer 4*a*, 4*b* by firing, and, patterns of a resistor paste or electrically-conductive paste for forming the heat-generating resistor and the lead portion, respectively, are formed on one of the main surfaces of the ceramic green sheet or molded product by means of screen printing or otherwise. As the material constituting the heat-generating resistor and the lead portion, a material composed predominantly of a high-melting-point metal that can be co-fired with ceramic, such as tungsten, rhenium, molybdenum, or a mixture of rhenium and tungsten, is used. The resistor paste and the electrically-conductive paste can be prepared by kneading a ceramic material, a binder, an organic solvent, and so forth in such a high-melting-point metal, and then kneading the admixture. Moreover, at this time, the position of heat generation and the resistance value of the heat-generating resistor 3 can be determined as desired by making changes to the length of the resistor paste- or electrically-conductive paste pattern for forming the heat-generating resistor 3, the length of the turn of the pattern and the distance between the turns, and the line width of the pattern, with consideration given to the application of the ceramic heater 1.

Then, on the ceramic green sheet or molded product formed with the patterns is placed another ceramic green sheet or molded product of the same material, and they are brought into intimate contact with each other via a lamination fluid, thereby forming a rod-like or plate-like molded product which constitutes a ceramic base body 4 having built-in heat-generating resistor 3 and lead portion 6.

The molded product is then allowed to stand for 1 hour or more in an atmosphere at a temperature of 50° C. and at a humidity of greater than or equal to 90% (hereafter referred to as "standing for diffusion"). As a result, the metal component contained in the paste for forming the heat-generating resistor is ionized and diffused in the ceramic green sheet or molded product. The region subjected to the diffusion of the metal component becomes a mixed-material layer following the completion of firing.

Next, the thusly obtained molded product is fired at a temperature in a range of about 1500° C. to 1600° C., whereby a ceramic heater having a mixed-material layer can be produced. It is preferable that the firing process is carried out in an atmosphere of a non-oxidizing gas such as hydrogen gas.

In the above case, since the metal component is diffused from the heat-generating resistor-forming paste to the entire area of a part of the ceramic green sheet kept in contact with the paste, it is possible to produce the ceramic heater 11 of the third embodiment in which the mixed-material layer 2*b* covers the entire heat-generating resistor 3.

As practiced in the first and second embodiments, where the formation of the mixed-material layer 2, 2*a* is limited to a specific location, the ceramic green sheet or molded product is calcined in advance. In the calcined ceramic green sheet or molded product, the metal component is not diffused even under the standing for diffusion. By contrast, in the ceramic green sheet or molded product that has not been calcined, the metal component is diffused under the standing for diffusion, wherefore the location of mixed-material layer formation can be controlled as intended.

How the ceramic heater of the invention is to be manufactured is not limited to the manufacturing method thus far described, but may be of, for example, a method comprising preparing ceramic green sheets containing a predetermined metal material, and stacking the sheets on top of each other in a specific region where it is desired to form a mixed-material layer, or, a method comprising preparing a paste containing a predetermined metal material, and printing the paste onto the heat-generating resistor-forming paste in overlaying relation within the range of a region where it is desired to form a mixed-material layer. According to this method, the mixed-material layer can either be of a type which contains the same metal material as that constituting the heat-generating resistor, or be of a type which contains a metal material different from the metal material constituting the heat-generating resistor. Moreover, the ceramic heater becomes capable of affording the effect of suppressing high-frequency component radiation (shielding effect) without fail.

EXAMPLES

The ceramic heaters as Examples of the invention were produced in the following manner.

<Sample 1>

At first, a ceramic green sheet was prepared so that it contains Al2O3 as a major constituent, and also contains SiO2, CaO, MgO, and ZrO2 in a total amount of no greater than 10% by mass. Then, on the surface of this ceramic green sheet was printed an electrically-conductive paste composed predominantly of rhenium for forming a heat-generating resistor, a lead portion, and a pad portion, in their respective patterns, by means of screen printing.

On the pattern was further printed a mixed-material layer-forming paste prepared by mixing powder having the same constituent components as those of the ceramic base body in an electrically-conductive paste composed predominantly of rhenium by means of screen printing. Moreover, a rod-like molded product was formed by means of extrusion molding using the same materials as those used for the ceramic green sheet. After that, the rod-like molded product was calcined at about 1200° C. The paste-printed ceramic green sheet and the rod-like calcined product were stacked on top of each other with application of a lamination fluid containing ceramic of identical composition in a dispersed state, whereby a rod-like stacked body was obtained.

The thusly obtained rod-like stacked body was fired in a reductive atmosphere (nitrogen atmosphere) at a temperature in a range of 1500 to 1600° C.

Next, a 2 to 4 μm-thick Ni plating film was formed on the pad portion at the outer surface of the ceramic base body by means of electrolytic plating, and, the pad portion was joined to a Ni-formed power-supply wiring line which is 0.8 mm in diameter and 50 mm in length using an Ag solder as a brazing material. In this way, Sample 1 was obtained.

<Sample 2>

A rod-like molded product was formed by means of extrusion molding using the same materials as those used for the ceramic green sheet. After that, the rod-like molded product was calcined at about 1200° C. The paste-printed ceramic green sheet and the rod-like calcined product were stacked on top of each other with application of a lamination fluid containing ceramic of identical composition in a dispersed state, whereby a rod-like stacked body was obtained.

Subsequently, the rod-like stacked body was allowed to stand for 1 hour at a temperature of 50° C. and at a humidity of 90%.

The thusly obtained rod-like stacked body was fired in a reductive atmosphere (nitrogen atmosphere) at a temperature in the range of 1500 to 1600° C.

Next, a 2 to 4 μm-thick Ni plating film was formed on the pad portion at the outer surface of the ceramic base body by means of electrolytic plating, and, the pad portion was joined to a Ni-formed power-supply wiring line which is 0.8 mm in diameter and 50 mm in length using an Ag solder as a brazing material. In this way, Sample 2 was obtained. In Sample 2, rhenium was diffused in the uncalcined ceramic green sheet under the standing for diffusion, whereby a mixed-material layer was formed.

<Sample 3>

The aforestated rod-like molded product was not calcined, and, a stacked body obtained by stacking the paste-printed ceramic green sheet and the uncalcined rod-like molded product on top of each other with application of a lamination fluid has been allowed to stand for 1 hour at a temperature of 50° C. and at a humidity of 90%, and the resultant rod-like stacked body was fired in a reductive atmosphere (nitrogen atmosphere) at a temperature in a range of 1500 to 1600° C. In this way, Sample 3 was obtained. In Sample 3, rhenium was diffused in the uncalcined rod-like molded product and the uncalcined ceramic green sheet under the standing for diffusion, whereby a mixed-material layer was formed.

<Sample 4>

The aforestated paste-printed ceramic green sheet and a non-printed ceramic green sheet formed of identical materials were stacked on top of each other with application of a lamination fluid to obtain a plate-like stacked body. Subsequently, the plate-like stacked body was allowed to stand for 1 hour at a temperature of 50° C. and at a humidity of 90%. The thusly obtained plate-like molded product was fired in a reductive atmosphere (nitrogen atmosphere) at a temperature in a range of 1500 to 1600° C. In this way, Sample 4 was obtained. In Sample 4, rhenium was diffused in the uncalcined ceramic green sheets under the standing for diffusion, whereby a mixed-material layer was formed.

<Samples 5 to 7>

Samples 5 to 7 were produced similarly to Samples 2 to 4, except that the standing for diffusion was not carried out.

<Sample 8>

Sample 8 was produced similarly to Sample 1, except that molybdenum was used instead of rhenium.

Each of Samples 1 to 8 was cut at its heat-generating resistor-including region and subjected to laser irradiation using a laser ablation system (LSX-200 manufactured by CETAC Technologies), and, the analysis of rhenium, as well as molybdenum that has been vaporized from the section was conducted by ICP mass spectrometer (Platform ICP manufactured by Micromass Ltd.).

In each of Samples 5 to 7 which were Comparative examples, rhenium was detected only in the heat-generating resistor. In each of Samples 1 to 4 which were Examples, rhenium was detected both in the heat-generating resistor and in its vicinity (mixed-material layer). Moreover, in Sample 8 which was Example, molybdenum was detected both in the heat-generating resistor and in its vicinity (mixed-material layer).

In Sample 1, rhenium was detected only in the vicinity of the outer main surface of the heat-generating resistor. The reason why rhenium was detected only in the vicinity of the main surface is because the mixed-material layer-forming paste was applied only in the vicinity of the main surface of the heat-generating-resistor pattern. On the other hand, no rhenium was detected in the vicinity of the inner main surface of the heat-generating resistor.

In Sample 2, rhenium was detected both in the vicinity of the outer main surface of the heat-generating resistor and in the vicinity of the side surface thereof. Rhenium was so distributed that its mixing rate became lower gradually from the heat-generating resistor outward away therefrom. No rhenium was detected in the vicinity of the inner main surface of the heat-generating resistor. This is presumably because the ceramic green sheet at the outer side contains a binder, whereas the rod-like calcined product at the inner side does not contain a binder, wherefore ionized rhenium has been diffused in the binder of the ceramic green sheet under the standing for diffusion.

In Sample 3, rhenium was detected in the vicinity of the outer main surface of the heat-generating resistor, in the vicinity of the side surface thereof, and also in the vicinity of the inner main surface thereof. Rhenium was so distributed that its mixing rate became lower gradually from the heat-generating resistor outward away therefrom.

In Sample 4, rhenium was distributed similarly to Sample 3.

Direct current was passed through each of Samples 1, 2, and 5 for examination of high-frequency noise and pulse waveforms of electric current flowing through the ceramic heater using an oscilloscope. In Samples 1 and 2, a sharp rise in pulse waveform appeared upon the passage of the electric current, but no high-frequency noise was observed. On the other hand, in Sample 5, a sharp rise in pulse waveform appeared upon the passage of the electric current, and simultaneously noise presumably attributed to a high-frequency component was observed.

The reason why no high-frequency noise was observed in Samples 1 and 2 is that a high-frequency component generated, with inrush current, in the heat-generating resistor has been attenuated by the mixed-material layer located close to the heat-generating resistor.

AC voltage was applied to each of Samples 4 and 7, and the surface temperature thereof was raised up to 500° C., and temperature distribution on the heater surface was checked with use of an infrared camera. More specifically, a maximum value and a minimum value of temperatures measured at several locations on the heater surface were determined, and, on the basis of the difference between the maximum and minimum values, temperature distribution evaluation was conducted. It is shown that, the smaller the temperature difference is, the more uniform the temperature distribution is.

In Sample 4, with only a 1° C. temperature difference in the temperature distribution, the rise in temperature was uniform throughout the sample. In Sample 7, there was a 5° C. temperature difference in the temperature distribution, and more specifically the temperature of the part corresponding to the heat-generating-resistor pattern was found to be higher than the temperatures of other parts.

Sample 4, being provided with the mixed-material layer, exhibited uniform surface-temperature distribution. This is presumably because heating uniformity was achieved in the rhenium-diffused region with consequent improvement in temperature distribution.

DC voltage was applied to each of Samples 3 and 6, and a change in electrical resistance was examined under continuous application at a surface temperature of 1200° C. Sample 3 was found to be smaller than Sample 6 in terms of the degree of change in electrical resistance over application time, and more specifically, in Sample 6, the heat-generating resistor suffered breaking after a period of about 200 hours, whereas in Sample 3, there was no breaking in the heat-generating resistor even after the same time period, namely 200 hours.

Sample 6 was cut for observation of its section, and the observation result showed that the cathode side turned black due to ion migration. This is presumably because magnesium and calcium contained in ceramic became positive ions and moved to the cathode side, which resulted in the blackening. On the anode side, breaking was identified that resulted from cracking due to volumetric expansion that was probably caused by oxidation ascribable to oxygen ions that have travelled thereto.

By contrast, in Sample 3, neither blackening of the cathode side nor volumetric expansion-induced cracking of the anode side was identified. This is presumably because the mixed-material layer was able to prevent ion migration.

Moreover, as the result of comparison in high-frequency noise between Sample 1 and Sample 8, there was no sign of high-frequency noise in both of them in the same way. DC voltage has been applied to each of Samples 1 and 8, and a change in electrical resistance was examined under cyclic application at temperatures ranging from ambient temperature to 1200° C. As a result, Sample 1 was found to be lower than Sample 8 in terms of the rate of change in resistance, and more specifically, in Sample 8, breaking took place after a period of 250 hours, whereas in Sample 1, there was no breaking in the heat-generating resistor even after the same time period, namely 250 hours. Samples 1 and 8 were cut for observation of their sections, and the observation result showed that the extent of blackening at the cathode side in Sample 8 is greater than that in Sample 1. It has also been confirmed that breaking occurred at the anode side in Sample 8 due to cracking caused by travelled oxygen ions. In Sample 1, the cathode side turned black a little, but no breaking occurred.

The only difference between Sample 1 and Sample 8 is the type of the metal material for use; that is, whether rhenium or molybdenum, and it will thus be seen that the use of rhenium is more desirable.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

1, 10, 11: Ceramic heater
2, 2*a*, 2*b*: Mixed-material layer
3: Heat-generating resistor
4: Ceramic base body
4*a*, 4*b*: Ceramic layer
6: Lead portion
6*a*: Via conductor
7: Pad portion
8: Power-supply wiring line

What is claimed is:

1. A ceramic heater, comprising:

a ceramic base body comprising a ceramic material;

a heat-generating resistor disposed in an interior of the ceramic base body, the heat-generating resistor generating heat by a passage of electric current therethrough; and a mixed-material layer disposed in the interior of the ceramic base body, the mixed-material layer consisting of a mixture of the ceramic material and a concentration of metal material within the ceramic material, wherein the mixed-material layer is disposed between the heat-generating resistor and a heating surface of the ceramic base body, and the mixed-material layer is configured so that the concentration of metal material decreases gradually with respect to an increase in a distance from the heat-generating resistor.

2. The ceramic heater according to claim 1, wherein the heat-generating resistor comprises a main surface opposed to the heating surface of the ceramic base body, and a side surface contiguous to the main surface, and wherein the mixed-material layer is disposed so as to cover the main surface and the side surface of the heat-generating resistor.

3. The ceramic heater according to claim 1, wherein the mixed-material layer is disposed so as to entirely cover the heat-generating resistor.

4. The ceramic heater according to claim 2, wherein the mixed-material layer is configured so that a thickness of a part thereof which covers the main surface of the heat-generating resistor opposed to the heating surface of the ceramic base body is larger than a thickness of a residual part of the mixed-material layer.

5. The ceramic heater according to claim 3, wherein the heat-generating resistor comprises a main surface opposed to the heating surface of the ceramic base body, and wherein the mixed-material layer is configured so that a thickness of a part thereof which covers the main surface of the heat-generating resistor opposed to the heating surface of the ceramic base body is larger than a thickness of a residual part of the mixed-material layer.

6. The ceramic heater according to claim 1, wherein the metal material is rhenium.

* * * * *